United States Patent [19]

Gomi et al.

[11] 4,197,021

[45] Apr. 8, 1980

[54] PRINTING HEAD FOR A WIRE-TYPE DOT PRINTER

[75] Inventors: Yoshifumi Gomi; Yoshito Ikeda, both of Shiojiri, Japan

[73] Assignees: Kabushiki Kaisha Suwa Seikosha, Tokyo; Shinshu Seiki Kabushiki Kaisha, Nagano, both of Japan

[21] Appl. No.: 905,083

[22] Filed: May 11, 1978

[30] Foreign Application Priority Data

May 13, 1977 [JP] Japan ..... 52-55109

[51] Int. Cl.[2] ..... B41J 3/12

[52] U.S. Cl. ..... 400/124; 101/93.05

[58] Field of Search ..... 400/124; 101/93.05

[56] References Cited

U.S. PATENT DOCUMENTS

| | | | |
|---|---|---|---|
| 3,770,092 | 11/1973 | Grim | 400/124 |
| 3,828,908 | 8/1974 | Schneider | 400/124 |
| 3,842,955 | 10/1974 | Iwasaki | 400/124 |
| 3,889,793 | 6/1975 | Cattaneo | 101/93.05 X |
| 4,049,107 | 9/1977 | Murat | 400/124 |
| 4,051,941 | 10/1977 | Hebert | 400/124 |

FOREIGN PATENT DOCUMENTS

| | | | |
|---|---|---|---|
| 7607826 | 4/1977 | Netherlands | 400/124 |

*Primary Examiner*—Paul T. Sewell

*Attorney, Agent, or Firm*—Blum, Kaplan, Friedman, Silberman & Beran

[57] ABSTRACT

The printing head for a wire-type dot printer includes a plurality of electromagnet coils, each on a coil core including a central post, said coil core and central post being of a magnetic material. Each of the coil cores is mounted on a frame having a cap for holding an operating plate which rotates around a fulcrum proximate the periphery of the printing head. The printing head is of reduced size and weight and is low in cost to manufacture.

4 Claims, 5 Drawing Figures

PRINTING HEAD FOR A WIRE-TYPE DOT PRINTER

BACKGROUND OF THE INVENTION

The conventional dot printer generally employs seven to nine printing wires actuated by an electromagnet in the dot head. An independent plunger-type electromagnet is provided for each printing wire, the whole being mounted on a frame of a non-magnetic substance. Adjustment is made by the use of screws on each of the respective electromagnets. Accordingly, the construction of such dot printers is both complex and costly. There is also a conventional dot printer in which a plurality of electromagnets are arranged on a frame of a magnetic material, the objective being to overcome these difficulties. The coils for driving the printing wires are arranged around the circumference and each is wound on a pair of ring-formed posts. The magnetic circuit includes a path on that portion of the electromagnet proximate the periphery of the frame as well as the portion proximate the central part of the printing head. Accordingly, the device is both heavy and bulky. In addition, the cost thereof is relatively high. The dot printer of the present invention overcomes these difficulties.

SUMMARY OF THE INVENTION

A printing head for a dot printer in accordance with the present invention has a plurality of driving coils located at the circumference thereof. At the center of each of the coils is a central post which forms a common magnetic path for the magnetic flux to be produced from the driving coil. An operating plate, having a plunger securely fixed thereto, is positioned for rotation about a fulcrum proximate the periphery of the frame. A holding cap holds the mounting plate in position. Bias means, preferably in the form of a spring, are provided for positioning the operating plate in a rest position in preparation for printing and subsequent to each printing step.

An object of the present invention is a printing head for a dot printer which is easy to assemble, simple to manufacture and of low cost.

Another object of the present invention is an improved printing head for a dot printer, said printing head and dot printer having an improved efficiency for carrying out printing operations, said improved efficiency resulting from simplification of the construction.

A further object of the present invention is printing head for a dot printer in which the size of the components can be reduced, thereby providing for reduction in the overall size and overall weight of said printing head and dot printer.

Still other objects and advantages of the invention will in part be obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENTS

Figure 1:
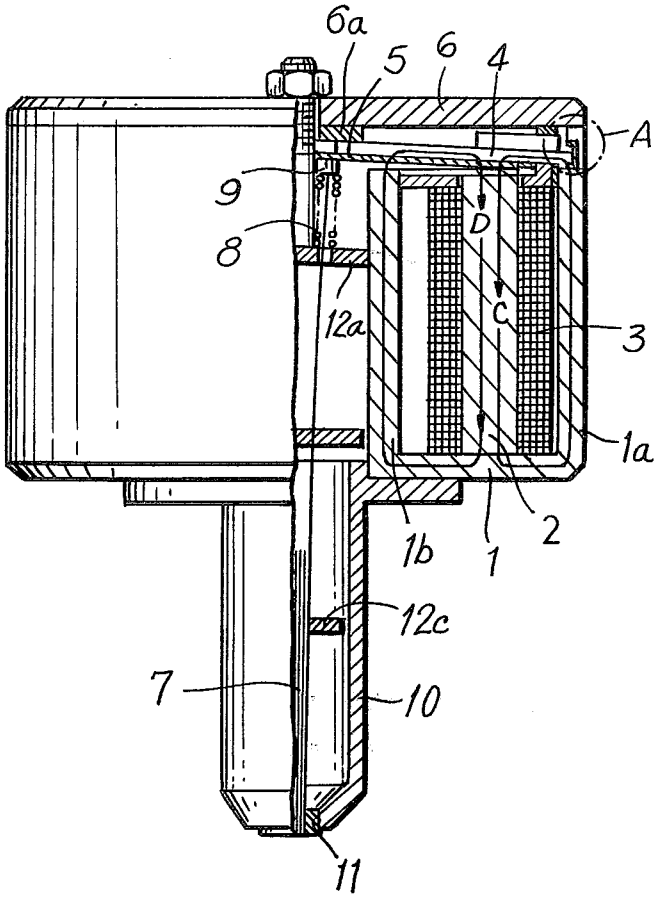
FIG. 1 PRIOR ART
FIG. 1 shows a conventional printing head for a dot printer.

As a basis for describing the improved printing head for a dot printer, hereinafter termed a "dot head," in accordance with the present invention, a conventional dot head is shown in FIG. 1. A frame 1 of a magnetic substance such as iron has a plurality of printing-wire driving coils 3 arranged on the circumference thereof, each driving coil being mounted on ring-formed posts 1*a* which is on the outer periphery of the dot head, and 1*b* which is on the inner periphery thereof. The coil cores of coils 3 are indicated by the reference numeral 2. Operating plate 4 has a fulcrum A between the periphery of holder 6 and ring-formed post 1*a*, holder cap 6 functioning to hold operating plate 4 in position. Sheeting 5 of a non-magnetic substance is positioned among operating plate 4 and ring-formed posts 1*a* and 1*b* and coil core 2 for the purpose of minimizing or preventing any influence of residual magnetic flux.

The other end of operating plate 4 is engaged with a printing wire pin 9 which is securely fixed to printing wire 7. The operating plate 4 is pressed toward a rest position, that is, in the non-printing direction, by means of printing wire reset spring 8. The reset spring 8 urges operating plate 4 against stopper 6*a* which is disposed on operating plate holder 6. The printing wire 7 protrudes through nose body 10 which has therein end guide 11 for guiding the printing end of the printing wire 7. Intermediate guides 12*a*, 12*b* and 12*c* are provided to prevent deformation of the printing wire 7 during actuation. To operate the device, current is passed through coils 3 as a result of a printing instruction; the magnetic flux produced by the coil passes through the ring-formed posts 1*a* and 1*b* as indicated by arrows C and D, attracting operating plate 4. Operating plate 4 rotates around fulcrum A as a support point, moving printing wire outwardly of the nose body 10, supplying the necessary energy to printing wire 7. This construction suffers from the defect that the ring-formed posts 1*a* and 1*b* are formed on both the outer and the inner peripheries of frame 1 and a plurality of coil cores 2 must be provided therebetween; moreover, the end face of coil core 2 and the ends of the ring-formed posts 1*a* and 1*b* must be on the same plane. This type of construction results in a difficult problem in the manufacturing thereof as is evident. These difficulties are overcome by the present invention as shown in the embodiment of FIG. 2.

Figure 2:
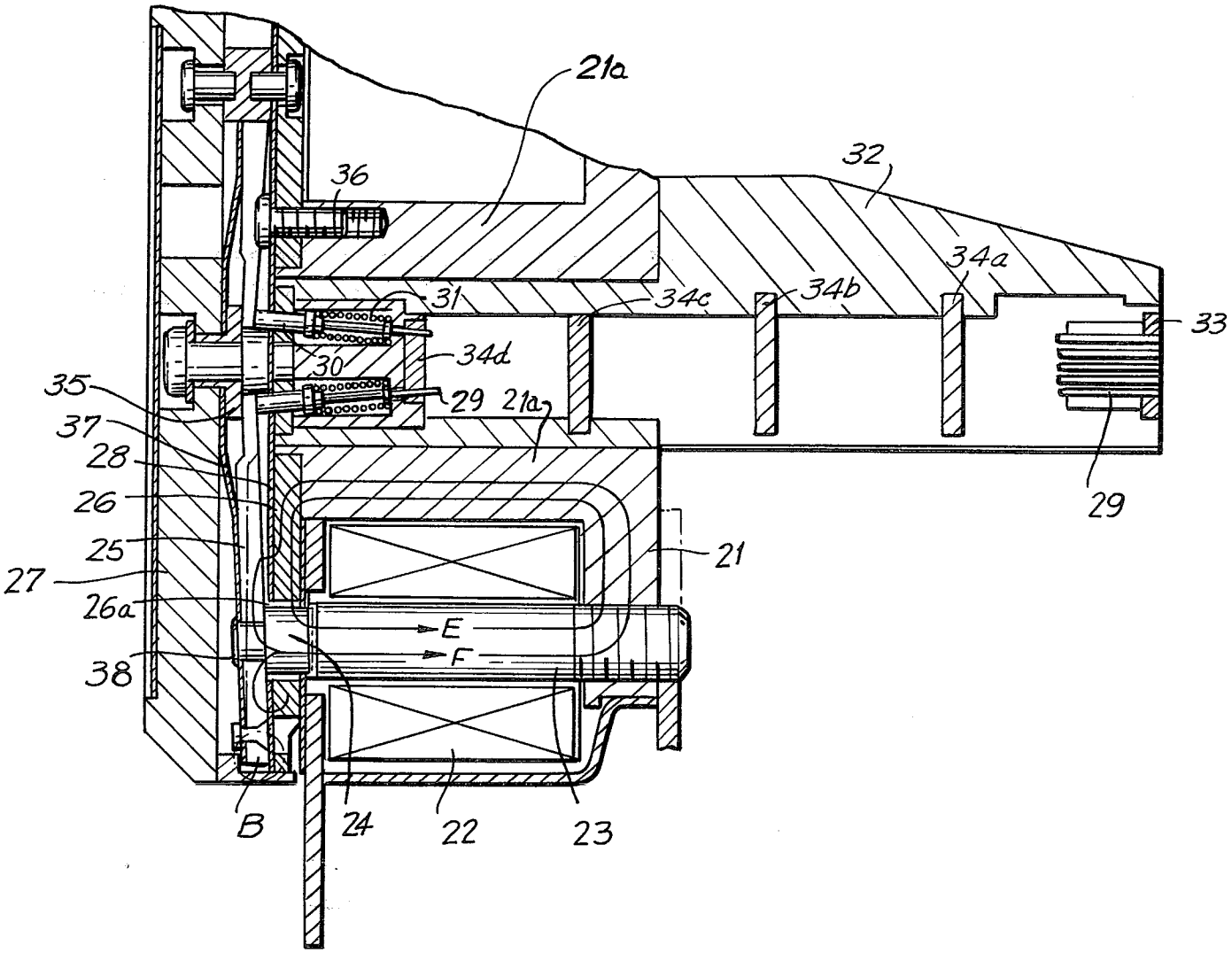
FIG. 2 is an embodiment of a printing head in accordance with the present invention.
Figure 4:
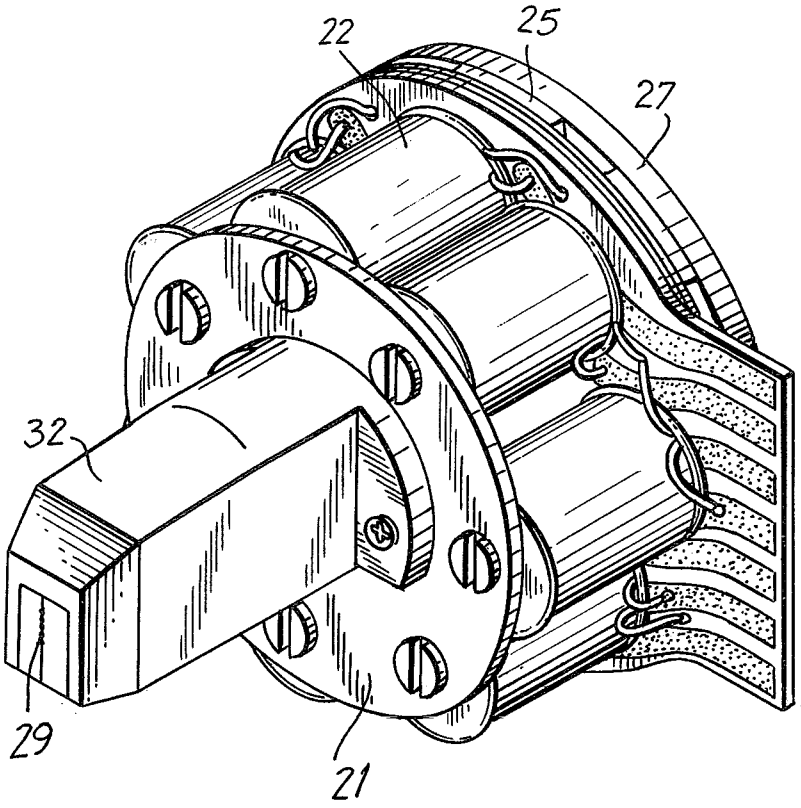
FIG. 4 is a schematic view of an embodiment in accordance with the present invention.
Figure 5:
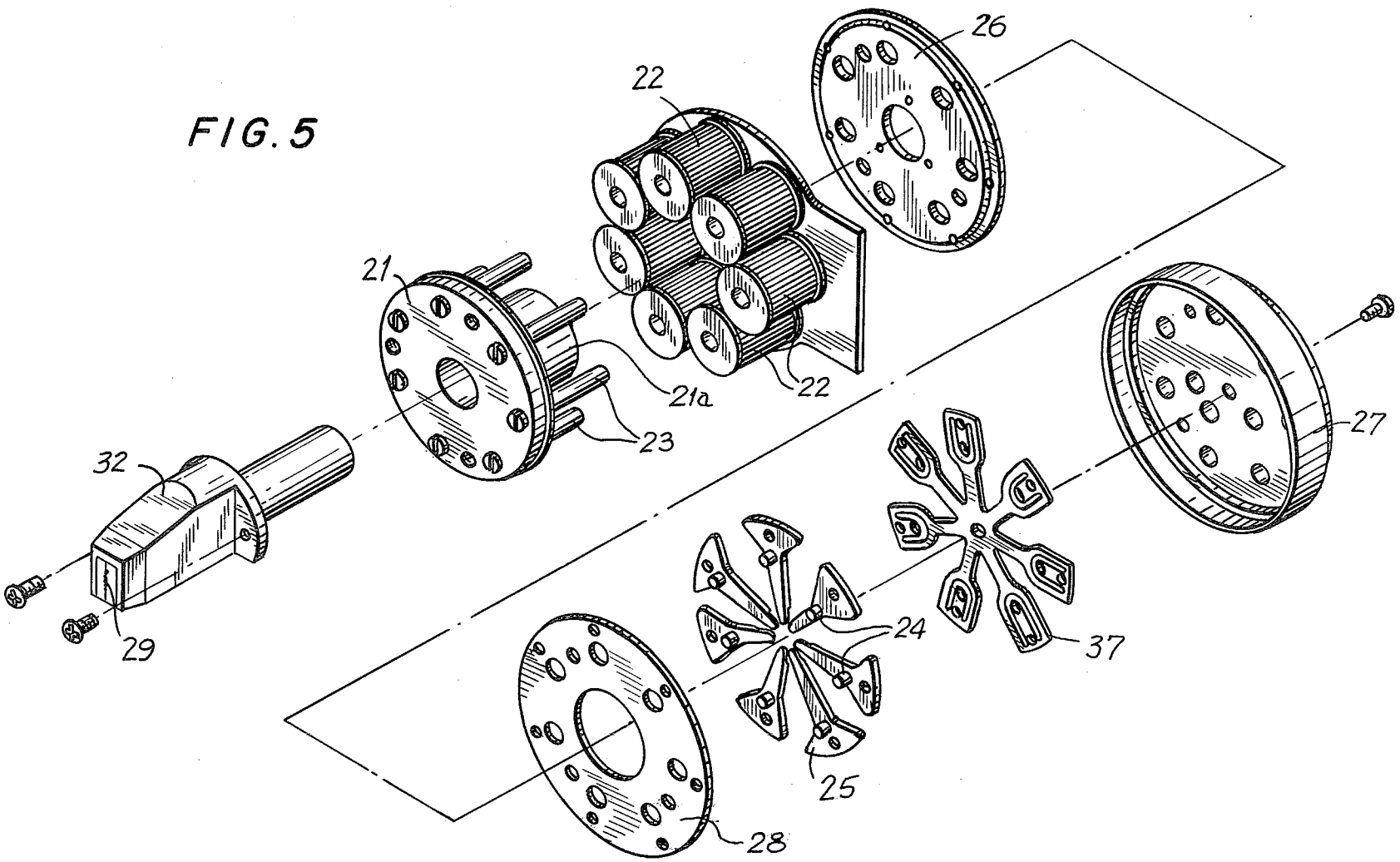
FIG. 5 is an exploded view in perspective of the embodiment of FIG. 4.

In the embodiment of FIG. 2, frame 21 has a plurality of driving coils 22 located about the circumference thereof, each of the driving coils 22 having a central opening at the center thereof, forming a common magnetic path for the magnetic flux produced when the driving coil 22 is actuated. Each coil is on a coil core 23. Operating plate 25 has a plunger 24 securely attached thereto. Mount 26 is provided for holding driven members, and has therein an opening 26*a* into which plunger 24 on operating plate 25 enters when driving coil 22 is actuated. Operating plate 25 is disposed between operating plate holder 27 and driven-member mount 26 and is held by the peripheries of said operating plate holder 27 and said driven member mount 26, said peripheries providing a fulcrum or support point B.

As indicated, one end of operating plate 25 is held at the peripheries of said mount 26 and said holder cap 27; the other end of said operating plate 25 is engaged with a printing wire pin 30. In rest or stand-by position operating plate 35 is urged against stopper 25 which is fitted to or is a portion of operating plate holder cap 27. Said other end of operating plate 25 engages printing wire pin 30, said pin being biased by printing-wire reset spring 31 which urges printing-wire 29 and operating plate 25 in the non-printing direction, that is, toward holder cap 27.

Sheeting 28 of non-magnetic material is held between operating plate 25 and driven member mount 26 for preventing any effect of residual magnetism upon the printing mechanism. Nose body 32 has an end guide 33 therein to guide the printing end of printing wire 29. Intermediate guides 34*a*, 34*b*, 34*c* and 34*d* are provided for preventing deformation of printing wire 29 during actuation.

The driven-member mount 26 on which operating plate 25 is disposed is securely affixed to the end face of central post 21*a* of frame 21 by means of a screw 36. Also, one end of operating plate 25 is securely affixed to the free end of a cantilever spring 37, and the other end of the operating plate 25 engages with the non-printing end surface of printing wire pin 30, the moment provided by the free end of the cantilever spring 37 resetting said other end of operating plate 25 in the non-printing direction subsequent to a printing operation.

The mode of operation of the embodiment of FIG. 2 is similar to that of the conventional device shown in FIG. 1 so that a detailed description thereof is not needed. It should be noted that the magnetic flux produced by driving coil 22 flows as indicated by the arrows E and F, this magnetic flux serving to drive operating plate 25.

The present construction permits the frame to be simplified relative to that shown in FIG. 1 so that the manufacturing process has fewer steps and a considerable reduction in manufacturing cost is affected. Also, an improved and simplified terminal treatment for the coils becomes possible. In addition, the fact that the coil is not completely enclosed on all sides greatly improves the thermal radiation therefrom. Also, driven member mount 26 is constructed so that it is attached by means of screws 36 to the end face of central post frame 21 which has the advantage of simplifying and easing the assembly whereby driving coil 22 is united with a base plate and put into the frame with the coil cores 23 securely fixed to the frame body as guides, driven member mount 26 then being mounted thereon. Operating plate holder cap 27 positions the end of cantilever spring 37 to be fixed. Cantilever spring 37 securely fixes operating plate 25 by fateners 38 and the mount 26 of the driven members are unified and fixed on central posts of frame 21 for further increasing the ease with which the head of the present invention can be assembled.

Figure 3:
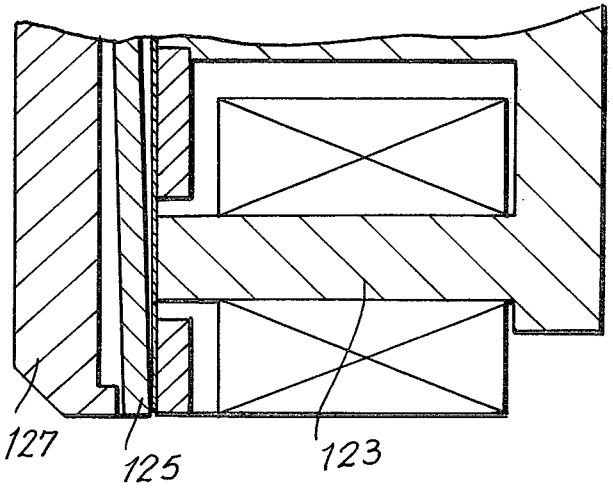
FIG. 3 shows the attracting portion of another embodiment in accordance with the present invention.

Loop E, as aforenoted, is provided for the flow of the magnetic flux which passes through opening 26*a* on driven member mount 26 and along the surface facing driven member mount 26 and operating plate 25, the material of operating plate 25 being a magnetic substance in the present embodiment. Since the intensity of the magnetic flux in loop F depends largely upon said facing area, it is possible to reduce the magnetic resistance at the junction and provide a magnetic circuit with high efficiency. When a quantity of magnetic flux indicated by the arrow E is sufficient, it is also possible to improve the response frequency of the electromagnet by using lighter material for the operating plate, as, for example, aluminum. Where aluminum is used, it is desirable that the surface be treated to harden same. Also, where the design is such, as shown in FIG. 3, that only the loop F is provided for the magnetic flux, then the construction may be improved in that the operating plate 125 may be directly attracted by coil core 123 with no plunger therebetween.

Constructions in accordance with the present invention lead to reduction in the cost of assembly due to reduction in the number of components, size of the components and increase ease of assembly. Also, operational characteristics are improved over those of the prior art in that heat is radiated more rapidly and effectively and tolerances need not be held so closely.

It will thus be seen that the objects set forth above, among those made apparent from the preceding description, are efficiently attained and, since certain changes may be made in the above construction without departing from the spirit and scope of the invention, it is intended that all matter contained in the above description of shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. A printing head for a wire-type dot printer, comprising a frame of a magnetic material having a central post having an opening therethrough; a plurality of driving means for displacing driven members through said opening, said driving means disposed on the periphery of said frame and including coil cores, electromagnetic coils on said coil cores, and a mount of a magnetic material disposed between said driven members and said coil cores, each said driven member including an operating plate and said printing head including a holder cap for holding said operating plate for rotation about a fulcrum between the periphery of said cap and the periphery of said mount and a plunger of a magnetic material securely attached to said operating plate and disposed for attraction by said coil core and thereby bring about rotation of said operating plate about said fulcrum, said coil core, said plunger and said frame constituting a common path for magnetic flux.

2. The printing head as claimed in claim 1, further comprising biasing means for returning said driven members to a rest position subsequent to displacement to a printing position by said activation of said coil core.

3. The printing head as claimed in claim 1, wherein said operating plate is of a magnetic material as part of said common path for magnetic flux.

4. The printing head as claimed in claim 1, wherein said operating plate is of aluminum, said aluminum plate having a hardened surface.

* * * * *